United States Patent [19]

DeYoung et al.

[11] Patent Number: 4,751,774

[45] Date of Patent: Jun. 21, 1988

[54] METHOD OF FABRICATING AN INK JET APPARATUS

[75] Inventors: Thomas W. DeYoung, Stormville, N.Y.; Arthur M. Lewis, Danbury, Conn.

[73] Assignee: Dataproducts Corporation, Woodland Hills, Calif.

[21] Appl. No.: 901,886

[22] Filed: Aug. 29, 1986

[51] Int. Cl.[4] ..... B41J 3/04

[52] U.S. Cl. ..... 29/25.35; 310/328

[58] Field of Search ..... 29/25.35; 310/328, 330; 346/140 R

[56] References Cited

U.S. PATENT DOCUMENTS 4,439,780 3/1984 DeYoung et al. ..... 310/328 X

FOREIGN PATENT DOCUMENTS 0178887 4/1986 European Pat. Off. ..... 346/140 R

*Primary Examiner*—Howard N. Goldberg
*Assistant Examiner*—Taylor J. Ross
*Attorney, Agent, or Firm*—Woodcock Washburn Kurtz Mackiewicz & Norris

[57] ABSTRACT

A method of fabricating an ink jet apparatus of the type having a plurality of variable volume chambers arranged in an array, each of the chambers adaptive to receive ink from a reservoir and including an orifice for ejecting droplets of ink-on-demand, is facilitated by utilizing a ganged array of transducer feet which are inserted into the chambers, joined to the respective transducer and unganged by lapping off an interconnecting web flushed with the forward face of the image head.

10 Claims, 3 Drawing Sheets

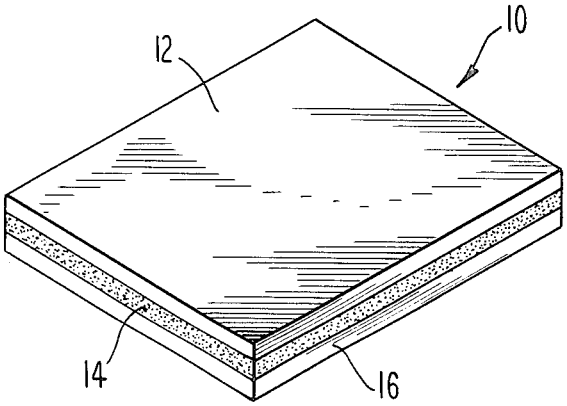
Fig. 1
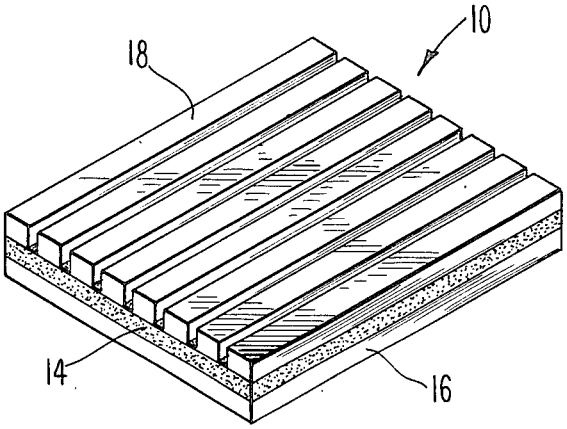
Fig. 2
Fig. 3
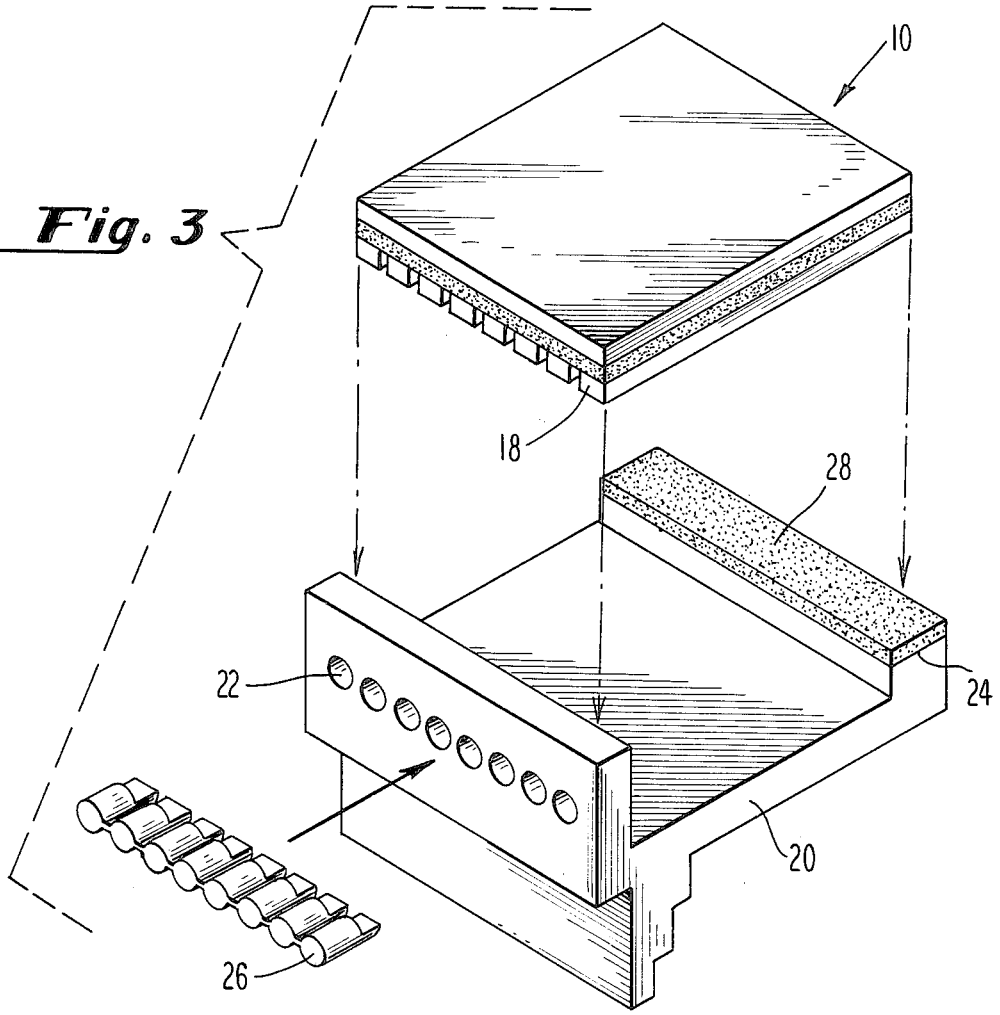

METHOD OF FABRICATING AN INK JET APPARATUS

BACKGROUND OF THE INVENTION

This invention relates generally to ink jet arrays which include a plurality of ink jet channels with each channel having a chamber, an inlet to the chamber, an orifice from the chamber, and transducer means coupled to the chamber for ejecting droplets of ink from the chamber as a function of the state of energization of the transducer. More particularly, this invention relates to an efficient method of fabricating a high-density ink jet array.

Within the art of ink jet printing, it is often desirable to employ a print head configuration which permits the utilization of a plurality of ink jets in a densely packed array such that a reasonably large area of a copy medium may be printed simultaneously. This is especially the case in the printing of alphanumeric information in which the resolution of individual characters as well as the speed of printing are of utmost importance.

One suitable such printer is described in U.S. Pat. No. 4,459,601, issued July 10, 1984 to Stuart D. Howkins, assigned to the assignee of the present invention and incorporated herein by reference. In that arrangement, an ink jet apparatus of the demand or impulse type comprises a chamber and an orifice in which droplets of ink are ejected in response to the state of energization of a transducer which communicates with the chamber through a foot forming a movable wall. The transducer expands and contracts, in a direction having at least one component extending parallel with the direction of droplet ejection through the orifice, and is elongated in such direction, the electric field resulting from the energizing or drive voltage being applied transversely to the axis of elongation.

One problem common to all high-speed, high-resolution, drop-on-demand ink jet printers occurs because the jets of an array are spaced very close to one another. That is, the response of one jet in an array to its drive voltage can be affected by the simultaneously application of a drive voltage to another nearby jet. This can result in a phenomenon, known in the art as "mechanical cross-talk", where pressure waves are transmitted through the solid material in which the jets are formed, or in another phenomenon known in the art as "electrical cross-talk", where relatively large drive voltages necessary for substantial displacement of transducers utilized in the prior art cause the subsequent pulsing of an inappropriate jet.

While the risk of electrical cross-talk between ink jets in an array utilizing the teachings of U.S. Pat. No. 4,459,601 as discussed above will be minimized, the risk of mechanical cross-talk remains. One approach which alleviates this problem, however, is discussed in U.S. Pat. No. 4,439,780, issued Mar. 27, 1984 to Thomas W. DeYoung and Viacheslav B. Maltsev, assigned to the assignee of the present invention and incorporated herein by reference. In that arrangement, an ink jet array comprises a plurality of elongated transducers coupled to a plurality of ink jet chambers, the transducers being supported only at their longitudinal extremities. The support at the extremity remote from the chamber is provided such that no longitudinal motion along the axis of elongation of the transducers occurs, while the support at the other extremity includes bearings which substantially preclude lateral movement of the transducers transverse to the axis of elongation but permit the longitudinal movement thereof along the axis, thus minimizing mechanical cross-talk between jets within the array.

As is more fully disclosed in the aforedescribed U.S. Pat. No. 4,439,780, the coupling means may comprise a foot attached to the transducer and the bearing means may comprise a hole receiving the foot. Preferably, the foot is cylindrical in cross-section and the hole is also cylindrical in cross-section with the hole slightly larger relative to the foot so as to assure no more than a line contact therebetween. The foot is subsequently "potted" within the hole by a viscoelastic material.

Other characteristic problems which are encountered in the implementation of high-speed, high-resolution impulse ink jet printers do not impact so much upon their operation, but indeed impact on their fabrication. For example, the relatively small sizes of transducer elements used in densely packed arrays make them difficult to handle. A unitary transducer array is, therefore, preferred.

One early approach towards the resolution of the above-described problem is disclosed in U.S. Pat. No. 4,072,959, which issued to Rune Elmqvist. As discussed therein, a recorder operating with drops of liquid includes a comb-shaped piezo electric transducer arranged such that individual teeth of the comb are associated respectively to a densely-packed array of ink jet chambers. Each of the transducers is immersed in a common reservoir such that energization of one transducer associated with one chamber may produce cross-talk with respect to an adjacent chamber or chambers. In other words, there is no fluidic isolation from chamber to chamber between the various transducers, or more accurately, segments of the common transducer. In addition to such cross-talk problems, the construction shown in the Elmqvist patent poses a requirement for a non-conductive ink.

It has been generally observed, however, that transducer-driven ink jets of apparently identical construction do not all operate over a single operating voltage range. This variation in operating voltage may result from such factors as variations in transducer material from piece to piece, variations in the acoustical coupling between the transducer and the remainder of the jet, or from other variations in structure which are not simple to control on a dimensional basis. These variations are troublesome in a manufacturing environment because they require the transducer driving electronics to be tuned to the jets on an individual basis where variations in transducer performance alone can be on the order of 15% to 20%. As a result, electronic configurations such a "resistor packs" which are well known in the art and used to individually tune the jets are desirably eliminated in an ink jet apparatus.

One means of reducing the variations in transducer from piece to piece is disclosed in copending application Ser. No. 902,473, filed Aug. 29, 1986, which is assigned to the assignee of the present invention and incorporated herein by reference. In that arrangement, a transducer array is produced in unitized fashion for ready assembly within an ink jet apparatus. The ink jet apparatus, in the preferred embodiment of that invention, includes a plurality of variable volume chambers, each of which is coupled to a respective element of the transducer array for ejection of ink through an associated orifice or jet. In order to fabricate the array, a monolithic slab of piezoelectric material, for example, lead zirconate titanate (PZT) is laminated to a rigid substrate such as glass by a selected thermoplastic cement. This lamina is then sized according to the desired number and dimensions and individual transducer elements and element spacing, and is subsequently diced to produce those elements. After such sizing and dicing, typically accomplished by a "dicing saw", the lamina is positioned PZT-side down with one end thereof being bonded by a structural-type electrically conductive epoxy to a shelf formed in the printer head. The other end is then operatively coupled to the variable volume chambers, and the resulting assembly is placed within an oven to cure. Once the structural-type electrically conductive epoxy has cured the oven's temperature is elevated to a point at which the thermoplastic cement will readily flow, thus facilitating the removal of the rigid substrate. Thereafter, the transducer elements can be electrically coupled by conventional means.

While the above described copending application Ser. No. 902,473, filed Aug. 29, 1986, reduces the variations in transducer material from piece to piece by producing a transducer array from a monolithic slab of piezoelectric material, variations in the acoustical coupling between the transducer and the remainder of the jet are still possible. One means of alleviating this problem, as disclosed in the aforedescribed U.S. Pat. No. 4,439,780, includes the use of a coupling means comprising a foot attached to the transducer and bearing means comprising a hole which receives the foot. Preferably, the foot is cylindrical in cross-section and the hole is also cylindrical in cross-section with the hole slightly larger relative to the foot so as to assure no more than a line contact therebetween. The coupling means further comprises a diaphragm between the chamber and the foot with a viscoelastic material sandwiched between the foot and the diaphragm assisting in the maintenance of the lateral position of the transducer at the diaphragm.

It will be appreciated, however, that an individual foot may be secured within the hole simply by means of a viscoelastic material such as silicone which is marketed under the name RTV. The ends of the transducers may be cemented to the feet by means of suitable adhesive such as an epoxy and the diaphragm may be eliminated. This "potted foot" configuration is presently preferred over the diaphragm designs illustrated herein for reasons of reliability and durability. Effective coupling of an individual transducer within a multichannel array is, nevertheless, hampered because of variations in structure which are not simple to control on a dimensional basis. A more efficient means of coupling is therefore desirable.

SUMMARY OF THE INVENTION

Accordingly, it is a general and object of the present invention to provide a means for use in an ink jet printing apparatus for the effective coupling of a transducer array to a corresponding number of variable volume chambers. More specifically, it is an object of this invention to provide an ink jet printer which is easily fabricated, capable of producing a high-resolution image at high rates of speed, and which minimizes cross-talk between jets in a multichannel array.

Another object of this invention is to provide an improved method for incorporating a unitized transducer array within an ink jet printer while minimizing variations in the acoustical coupling between the array and the remainder of the jet.

Still another object of this invention is to provide an ink jet printer with a minimum of parts.

Briefly, these and other objects of the present invention are accomplished by an ink jet apparatus including a plurality of variable volume chambers, each of which is coupled to a respective element of a transducer array for the ejection of ink through an associated orifice or jet. In accordance with one important aspect of this invention, each of the transducer elements in the array are coupled to a respective one of the plurality of variable volume chambers by attaching it to a transducer foot which is "potted" within the chamber. The transducer foot in the preferred embodiment is but one of an array of ganged transducer feet joined together by a common web and inserted through the orifice side of the variable volume chamber. Thereafter, in accordance with a method consistent with the invention, the transducer feet are inserted through the chambers, affixed to the end of the transducer elements, separated each from the other by lapping off their interconnecting web, and potted within the variable volume chambers with a viscoelastic material.

In accordance with yet another important aspect of the invention, the ganged foot array is utilized to connect a transducer array comprised of a monolithic slab of piezoelectric material, for example, lead zirconate titanate, which is laminated to a rigid substrate such as glass by a selected thermoplastic cement. This lamina is then sized according to the desired number and dimension of individual transducer elements and interelement spacing, and is subsequently diced to produce those elements. After such sizing and dicing the lamina is positioned PZT-side down with one end thereof being bonded by a structural-type electrically conductive epoxy to a shelf formed in the printer head. The other end is then operatively coupled by joining each transducer element to a respective one of the transducer feet within the array, thereby coupling the transducer elements to the variable volume chamber.

Other objects, advantages and novel features of this invention will become apparent from the following detailed description of a preferred embodiment when considered in conjunction with the accompanying drawings:

BRIEF DESCRIPTION OF THE DRAWINGS

FIG. 1 shows a lamina of piezoelectric material which is bonded to a rigid substrate;

FIG. 2 shows the lamina of FIG. 1 after its sizing and dicing;

FIG. 3 illustrates the exploded assembly of the sized and diced lamina of FIG. 2 into a printer head.

DETAILED DESCRIPTION OF THE PREFERRED EMBODIMENT

Figure 3A:
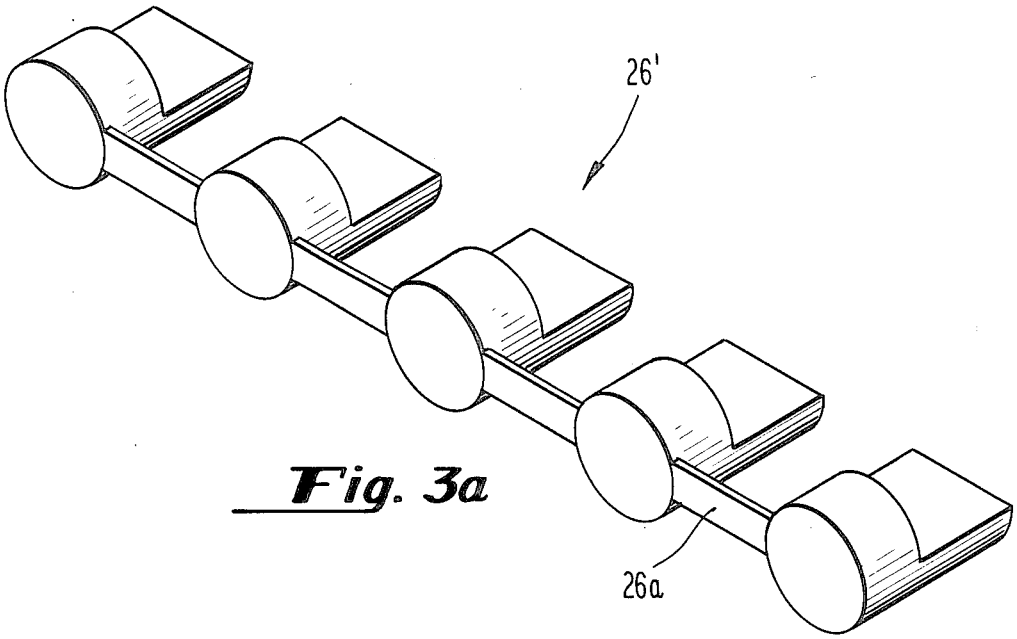
FIG. 3*a* shows a preferred embodiment of the ganged array of transducer feet incorporated within the assembly of FIG. 3.

Referring now to the drawings, wherein like characters designate like or corresponding parts through the several views, there is shown in FIG. 1 a lamina 10 having a first layer 12 of piezo electric material which is bonded by a layer 14 of thermoplastic cement to a second layer 16 comprising a rigid substrate. The piezoelectric layer 12 comprises a conventionally poled ferroelectric ceramic, such as a lead zirconate titanate (PZT) which has been exposed to an original DC polarizing field. As is well known in the art, the polar axis of such piezoelectric ceramics is parallel to the original DC polarizing field. It will appreciated from the following discussion, therefore, that the piezoelectric layer 12 includes a negative or ground plane which, according to the invention, faces out when incorporated within the lamina 10. The lamina 10, as shown in FIG. 2, is then sized and diced by a conventional saw to produce an array of transducer elements 18. In accordance with an important aspect of this invention, the sizing step determines the outside dimensions of the transducer array: that is, the overall length and width of the lamina 10 is determined by the desired number and length of the transducer elements 18. Thereafter, the dicing step produces the individual transducer elements 18 and ensures a proper element width and spacing therebetween within the array.

Referring now to FIG. 3, the sized and diced lamina 10 is shown ready for positioning within a printer head 20. The printer head 20 includes at one end thereof a plurality of chambers 22, and at the other end a shelf portion 24 upon which the lamina 10 will be supported. As discussed thus far, the above method of fabricating an ink jet printer is consistent with the disclosure of copending application Ser. No. 902,473, filed Aug. 29, 1986. In accordance with a preferred embodiment of this invention, a ganged array of transducer feet 26 as shown more clearly in FIG. 3*a* is inserted through the chambers 22 thereby providing a second point of attachment for each of the transducer elements 18. A layer of structural-type conductive epoxy 28 is applied to the shelf 24 and each of the feet 26. The lamina 10 is then attached to the printer heads 20 such that each of the transducer elements 18 is aligned with a respective foot 26 and supported upon the shelf 24.

Referring now to FIG. 3*a*, there is shown a preferred embodiment of the present invention. Comprised of a molded assembly of individual feet 26 joined together by an interconnecting web 26*a*, the ganged array 26' may be fabricated from a plastic or ceramic material which is capable of being bonded to the transducer elements 18. It will be understood that the individual feet 26, after separation, form a movable wall at the rear of the variable volume chambers formed by the chambers 22 within the print head 20. The array 26' may be formed as shown in FIG. 3*a*. Each of the feet 26 generally comprise a substantially cylindrical portion 26*b* having a horizontal shelf 26*c* molded therein. The shelf 26*c* is adapted to hold an individual transducer element 18 as well as a suitable adhesive 28 bonding the two together.

Figure 3B:
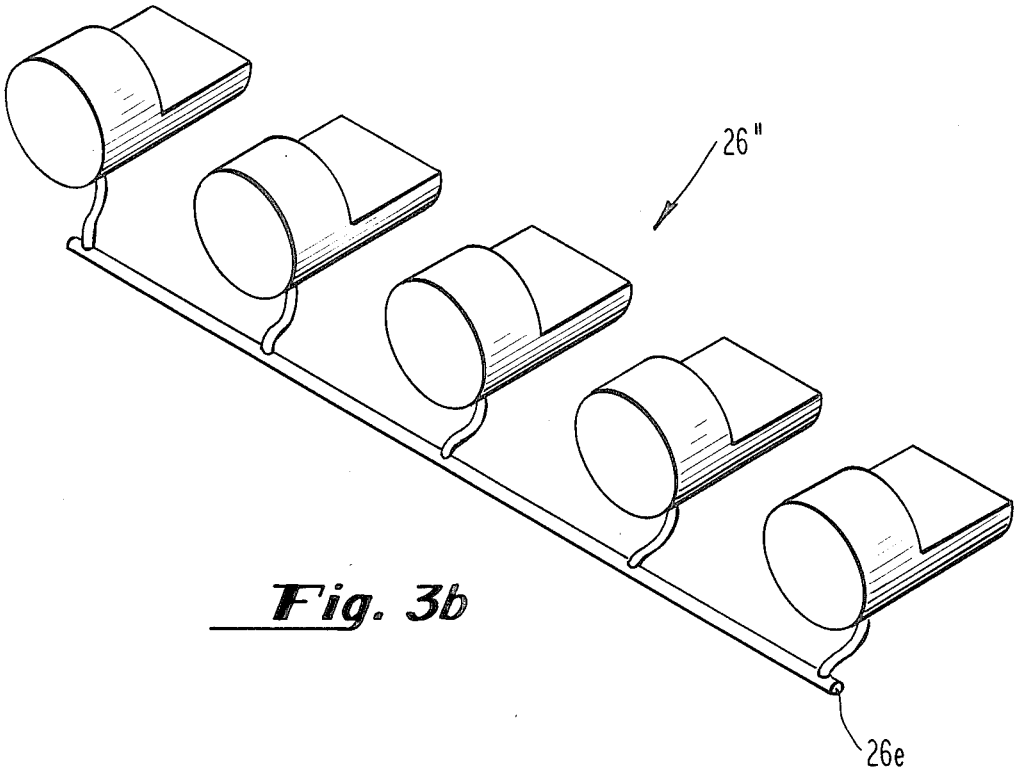
FIG. 3*b* shows an alternative embodiment of a ganged array of transducer feet which may be incorporated into the assembly of FIG. 3.

Referring now to FIG. 3*b*, there is shown an alternative embodiment of the present invention. As in the preferred embodiment of FIG. 3*a*, the individual transducer feet 26 may be generally comprised of a subtantially cylindrical portion 26*a* having the shelf 26*d* formed at their distal ends as shown in FIG. 3. It will be readily apparent from FIG. 3*b* that the individual transducer feet 26 are not joined together by a rigid interconnecting web as in the preferred embodiment of FIG. 3*a*. Instead, a thin rod 26*e* having a plurality of fine, flexible fingers 26*f* connected between the transducer feet 26 and the rod 26*e*. The ganged array 26'' as shown in FIG. 3*b* is, accordingly, inserted through the holes 22 from the back side of the print head 20 in a manner opposite to that shown in FIG. 3. Thereafter, the individual feet 26 are joined to respective transducer elements 18 and the feet 26 are potted with a viscoelastic material or elastomeric potting compound 38. In this manner, no post assembly processes are required to remove the interconnection of individual feet, since the fine flexible fingers 26*f* permit the movement of individual transducer 26 as attached to the transducer elements 18 without causing substantial loading. It should be noted, however, that the array 26'' must be flexible enough to permit movement of the foot 26 within the holes 22 without substantially loading its respective transducer element 18, thereby requiring the individual transducer elements 18 to be tuned and adjusted for a common drive voltage through the installation of suitable electronics such as a resistor pack.

Figure 4:
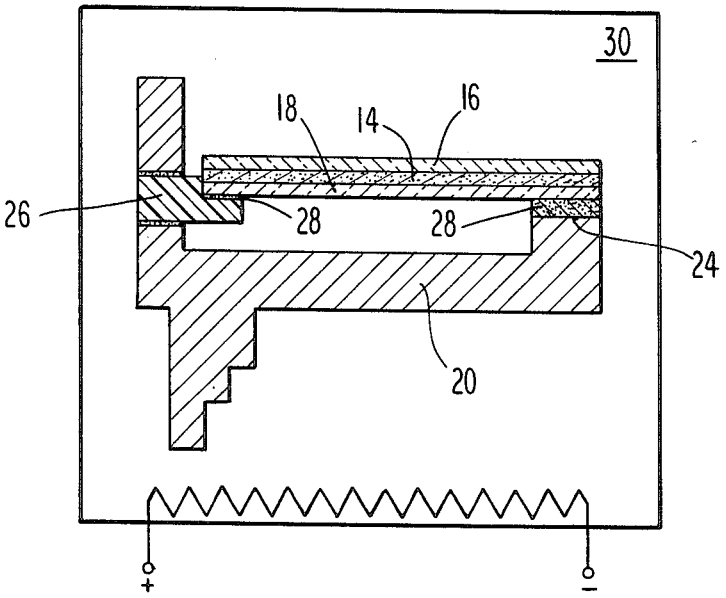
FIG. 4 illustrates in cross-section the assembly of FIG. 3 while it is curing within an oven.
Figure 5:
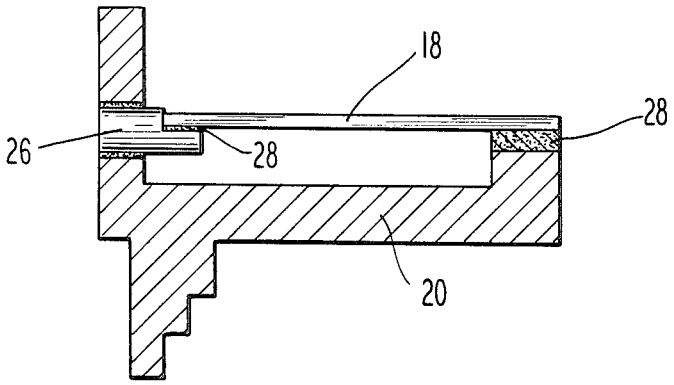
FIG. 5 shows a cutaway view of the assembly after removal of its rigid substrates.

The epoxy 28 may then be cured in an oven 30 as shown in FIG. 4. In accordance with another important aspect of the invention, the thermoplastic cement 14 and epoxy 28 must be carefully selected to ensure they provide the proper bond strengths. For example, the thermoplastic cement 14 must provide a tenacious bond between the PZT layer 12 and the rigid substrate 16 in order to effectively size and dice the lamina 10 for production of uniform transducer elements 18. Moreover, the thermoplastic cement 14 must be capable of withstanding temperatures required to cure the epoxy 28 without melting, must itself be chemically compatible with the epoxy 28, and must be readily soluble in standard cleaning solutions. One suitable such thermoplastic cement 14 is Struers Lakeside 70*c* cement, a registered trademark of H. Courtright and Company, Chicago, Ill. A suitable compatible epoxy 28 which was used in a preferred embodiment invention is EPO-TEK-H20E, a two component, silver filled epoxy produced by Epoxy Technology, Inc., Billerica, Mass. Referring again to FIG. 4, it will be appreciated that the temperature of the oven 30 which is selected to cure the epoxy 28 must also prevent the melting of the thermoplastic cement 14 once the epoxy 28 is cured. The temperature of the oven 30 is elevated to a point at which the thermoplastic cement 14 will readily flow, thereby freeing the rigid substrate 16 from the array of transducer elements 18 as shown if FIG. 5. After the rigid substrate 16 is removed, the transducers 18 and printer head 20 are cleaned using such standard solvents as alcohol, acetone, or a solution of borax and water.

Figure 6:
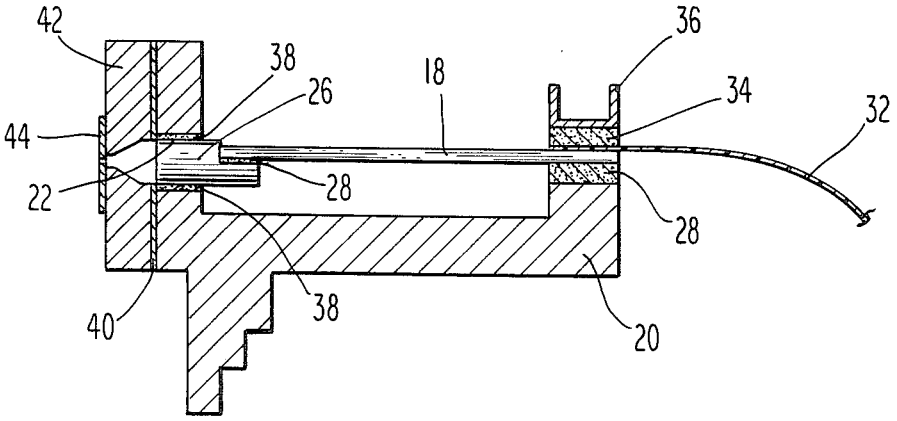
FIG. 6 shows a cutaway view of an ink jet printer which incorporates a transducer array and ganged feet according to the present invention.

Upon cleaning, subsequent assembly operations may be carried out as shown is FIG. 6, and as more fully described in copending application Ser. No. 902,473 filed Aug. 29, 1986. Most importantly, the interconnecting web joining the transducer feet 26 of the array 26 prime as shown in FIG. 3*a* must be lapped off flush with the surface of the forward face of the printer head 20. Thereafter, fluidic supply and ejection means, such as a restricter plate 40, a chamber plate 42, and an orifice plate 44 may be attached to complete the assembly of an exemplary ink jet printer.

As utilized herein, the term elongated is intended to indicate that the length is greater than the width. In other words, the axis of elongation has utilized here and extends along the length which is greater than the transverse dimension across which the electric field is applied. Moreover, it will be appreciated that the particular transducer may be elongated in another direction which might be referred to as the depth and the overall depth may be greater than the length. It will, therefore, be understood that the term elongation is a relative term. Moreover it will be understood that the transducer will expand and contract in other directions in addition to along the axis of elongation but such expansion and contraction is not of concern because it is not in the direction of coupling provided by the ganged array 26'. In the embodiments shown herein, the axis of coupling is the axis of elongation.

Although particular embodiments of the invention have been shown and described, other embodiments will occur to those of ordinary skill in the art which fall within the true spirit and scope of the appended claims.

What is claimed is:

1. A method of fabricating an ink jet apparatus, comprising the steps of:

forming an image head assembly having a plurality of chambers arranged in an array, each of said chambers adapted to receive ink from a reservoir and including an orifice for producing droplets of ink on demand, said chambers having a movable side and an orifice side;

mounting an array of transducer element upon said image head assembly, each of said transducer elements adapted to be coupled to a respective one of said chambers; and operatively coupling an array of transducer feet to said chambers and said plurality of transducer elements, each of said feet to a respective chamber for creating selective volumetric changes therein responsive to the state of energization of its respective transducer element, wherein each of said feet are formed of a preselected material and are joined together by ganging means formed of said preselected material.

2. A method of fabricating a ink jet apparatus according to claim 1, wherein said mounting step further comprises:

releasably mounting upon a rigid substrate a monolithic slab of piezoelectric material having a positive poled face and a ground plane face.

dicing said slab to produce a plurality of transducer elements of predetermined width and spacing which correspond to the spaced relationship of said chambers;

electrically coupling the ground plane face of said diced slab comprising said transducer elements to said image head assembly;

removing said rigid substrate; and electrically coupling the positive poled face of said diced slab comprising said transducer elements to an energization source.

3. A method of fabricating an ink jet apparatus according to claim 1, wherein said operative coupling step further comprises:

inserting said ganged array of transducer feet through said image head assembly, each of said feet through a respective chamber at its orifice side;

affixing to each of said plurality of transducer elements a respective transducer foot;

unganging said array of transducer feet.

4. A method according to claim 3, wherein said unganging step comprises the steps of:

rough cutting a web interconnecting the individual transducer feet; and lapping said web and said feet to produce a surface which is flush to the forward face of said image head assembly.

5. A method according to claim 1, wherein said operative coupling step further comprises:

inserting said ganged array of transducer feet through said image head assembly, each of said feet to a respective chamber at its movable side; and affixing to each of said plurality of transducer elements a respective transducer foot.

6. A method according to claim 1, further comprising the step of potting said feet within said chambers utilizing a viscoelastic material.

7. A method of fabricating an ink jet apparatus, comprising the steps of:

forming an image head assembly having a plurality of chambers arranged in an array, each of said chambers adapted to receive ink from a reservoir and includng an orifice for producing droplets of ink on demand, said chambers having a movable side and an orifice side;

mounting an array of transducer elements upon said image head assembly, each of said transducer elements adapted to be coupled to a respective one of said chambers, wherein said mounting step further comprises releasably mounting upon a rigid substrate a monolithic slab of piezoelectric material having a positive poles face and a ground plane face, dicing said slab to produce a plurality of transducer elements of predetermined width and spacing which correspond to the spaced relationship of said chambers, electrically coupling the ground plane face of said diced slab comprising said transducer elements to said image head assembly, removing said rigid substrate, and electrically coupling the positive poled face of said diced slab comprising said transducer elements to an energization source; and operatively coupling a ganged array of transducer feet to said chambers and said plurality of transducer elements, each of said feet to a respective chamber for creating selective volumetric changes therein responsive to the state of energization of its respective transducer element.

8. A method of fabricating an ink jet apparatus, comprising the steps of:

forming an image head assembly having a plurality of chambers aranged in an array, each of said chambers adapted to receive ink from a reservoir and including an orifice for producing droplets of ink on demand, said chambers having a movable side and an orifice side;

mounting an array of transducer elements upon said image head assembly, each of said transducer elements adapted to be coupled to a respective one of said chambers; and operatively coupling a ganged array of transducer feet to said chambers and said plurality of transducer elements, each of said feet to a respective chamber for creating selective volumetric changes therein responsive to the state of energization of its respective transducer element, wherein said operative coupling step further comprises inserting said ganged array of transducer feet through said image head assembly, each of said feet through a respective chamber at its orifice side, affixing to each of said plurality of transducer elements a respective transducer foot, and unganging said array of transducer feet.

9. A method according to claim 8, wherein said unganging step comprises the steps of:

rough cutting a web interconnecting the individual transducer feet; and lapping said web and said feet to produce a surface which is flush to the forward face of said image head assembly.

10. A method of fabricating an ink jet apparatus, comprising the steps of:

forming an image head assembly having a plurality of chambers arranged in an array, each of said chambers adapted to receive ink form a reservoir and including an orifice for producing droplets of ink on demand, said chambers having a movable side and an orifice side;

mounting an array of transducer elements upon said image head assembly, each of said transducer element adapted to be coupled to a respective one of said chambers;

operatively coupling a ganged array of transducer feet to said chambers and said plurality of transducer elements, each of said feet to a respective chamber for creating selective volumetric changes therein responsive to the state of energization of its respective transducer element; and potting said feet within said chambers utilizing a viscoelastic material.

* * * * *

UNITED STATES PATENT AND TRADEMARK OFFICE

CERTIFICATE OF CORRECTION

PATENT NO. : 4,751,774

DATED : June 21, 1988

INVENTOR(S) : DeYoung et al.

It is certified that error appears in the above-identified patent and that said Letters Patent is hereby corrected as shown below:

Column 7, line 55, please change the word "element" to --elements--.

Column 8, line 24, please change the word "includng" to --including--.

Column 8, line 33, please change the word "poles" to --poled--.

Signed and Sealed this

Tenth Day of January, 1989

*Attest:*

DONALD J. QUIGG

*Attesting Officer*

*Commissioner of Patents and Trademarks*